114-253 SR
4/28/81 XR 4,263,685

United States Patent [19]
Neuscheler

[11] 4,263,685
[45] Apr. 28, 1981

[54] HANDLE FOR WATER SKI TOWLINE WITH ENGAGEMENT AND DISENGAGEMENT MEANS FOR WATER SKI SAFETY BELT

[76] Inventor: Wilhelm Neuscheler, Spitzholzstr. 113, 7032 Sindelfingen, Fed. Rep. of Germany

[21] Appl. No.: 5,232

[22] Filed: Jan. 22, 1979

[30] Foreign Application Priority Data

Jan. 20, 1978 [DE] Fed. Rep. of Germany ..... 2802302

[51] Int. Cl.[3] ..... A63C 11/10; B63B 21/56
[52] U.S. Cl. ..... 9/310 A; 114/253
[58] Field of Search ..... 182/3, 9; 115/6.1; 114/253; 9/310 A, 310 AA, 310 R; 24/201 R, 132 R, 133; 244/151 R, 151 A, 151 B

[56] References Cited

U.S. PATENT DOCUMENTS

| | | | |
|---|---|---|---|
| 2,754,073 | 7/1956 | Holm | 24/201 R |
| 2,940,148 | 6/1960 | Gentle | 24/201 R |
| 3,071,100 | 1/1963 | Nicholson | 115/6.1 |
| 3,324,818 | 6/1967 | Dunlap | 115/6.1 |
| 3,494,319 | 2/1970 | Dunlap | 115/6.1 |
| 4,140,205 | 2/1979 | Matson | 115/6.1 |

*Primary Examiner*—Trygve M. Blix
*Assistant Examiner*—D. W. Keen
*Attorney, Agent, or Firm*—Craig and Antonelli

[57] ABSTRACT

A handle assembly for a water ski towline having a handle and mechanism for engagement and disengagement of a safety belt for water skiers. The handle is joined with the engagement and disengagement mechanism and has a device for retaining a pull strap of a safety belt connecting strap by engagement with one hand of the user during the starting process and during skiing, whereby the entire tensile forces exerted by the towline are transmitted to the safety belt and thus to the body of the water skier.

10 Claims, 5 Drawing Figures

HANDLE FOR WATER SKI TOWLINE WITH ENGAGEMENT AND DISENGAGEMENT MEANS FOR WATER SKI SAFETY BELT

BACKGROUND AND SUMMARY OF THE INVENTION

The present invention relates to a handle for a water ski towline with engagement and/or disengagement means for a safety belt for water skier, this belt being applied approximately at the chest level of the skier.

It is known that a water skier must expend great strength during starting while emerging from the water; this strength exerts great stress especially on the arm muscles. To make water skiing possible even for those persons who do not possess the required strength in their arms, especially elderly persons and above all beginners, the present invention has been provided. The invention requires absolutely no arm strength; such strength merely has to be expended for balancing during starting and during skiing on the water. The forces occurring during those steps are very minor. After starting, the disengagement means can be activated, if desired, without letting go of the handle; it is merely necessary to straighten the index and middle fingers of the right hand, thus releasing the connection between the handle and the safety belt. At this point, water skiing can proceed as usual. It is also possible to re-engage the safety belt again during skiing, if the arms become tired after a rather long skiing period. In case of waves, provision is made to fashion a portion of the water ski towline as a rubber cable which has the purpose of compensating for the differing velocities of the towing boat or the towing device and the water skier, which difference can ensue primarily from the waves. Furthermore, an impressive effect can be achieved by the rubber cable when slalom skiing, in that higher speeds are attained after turning.

Attempts have also been made to improve the hold on the handle by having a contact element, to which the water ski towline is attached and is guided at the handle, press against the fingers and/or the topside of the hand and hold same, so to speak, in clamping engagement (see DOS [German Unexamined Laid-Open Application] 2,202,841). However, this prior art arrangement provides no advantage as compared to conventional handles because the water skier's arms must still absorb the necessary forces. Furthermore, in case of a false start, there is the danger that the water skier cannot free his hands from the clamp and is pulled underwater, which can be very troublesome at the least or be even worse, if the water skier comes to a fall while at top speed, for example, after turning during slalom skiing.

These last-mentioned disadvantages are avoided by a preferred embodiment of the present invention in that the entire force produced by the water ski towline is transmitted, via the handle, by means of a connecting strap through the safety belt to the body of the water skier. The disengagement means at the handle is dimensioned so that, for example, in case of a false start, after the handle has been released, the connection with the towline and the safety belt is severed, and thus nothing can happen. The ready disengagement at the handle is effected by the feature of the preferred embodiment that the disengagement lever, during its connection with the pull strap, which latter is joined, with an adjustable strap, to the safety belt of the water skier, has an unobstructing corresponding inclination with respect to the towing direction and, after the handle has been released and/or after the index and middle fingers of the right hand have been straightened, slides off this inclination and completes the separation of the water ski towline and the safety belt. A flat or plate spring further enhances the disengagement effect. The spring furthermore serves the purpose of improving the locking engagement of the pull strap of the safety belt.

These and further object, features and advantages of the present invention will become more obvious from the following description when taken in connection with the accompanying drawings which show, for purposes of illustration only, a single embodiment in accordance with the present invention.

DETAILED DESCRIPTION OF THE PREFERRED EMBODIMENT

Figure 1:
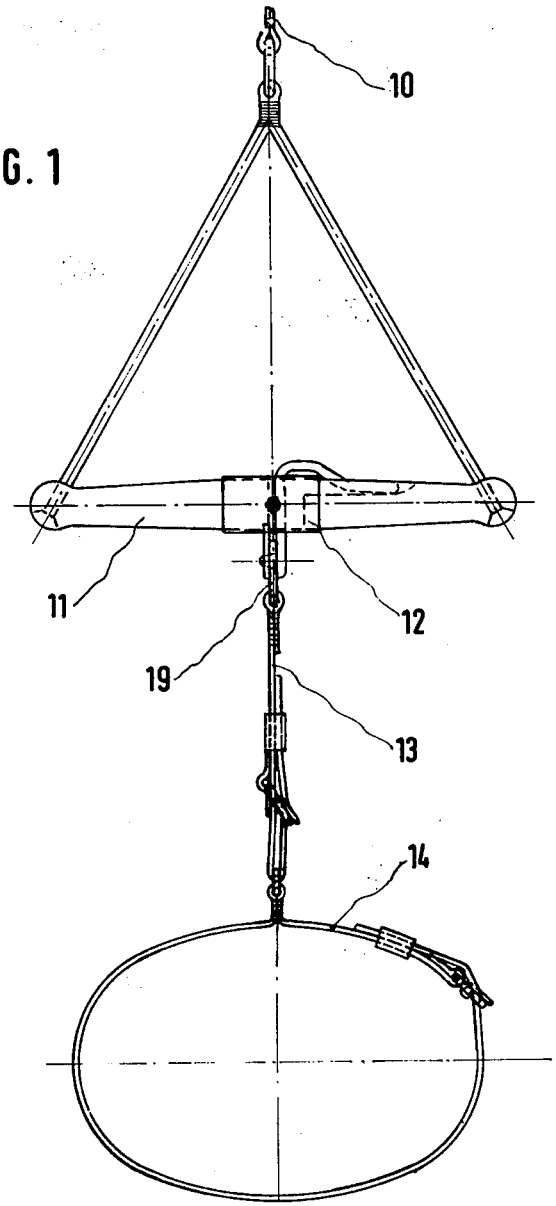
FIG. 1 shows a perspective view of a handle for a water ski towline with an engagement and/or disengagement means for a water ski safety belt.

FIG. 1 shows the arrangement of one embodiment of a handle for a water ski towline with an engagement and/or disengagement means for a water ski safety belt. The towline is denoted by 10, the handle assembly with a triangular cable and a spring safety hook by 11, the complete engagement and/or disengagement means by 12, the adjustable connecting strap by 13, and the likewise adjustable safety belt for water skiers by 14.

Figure 2:
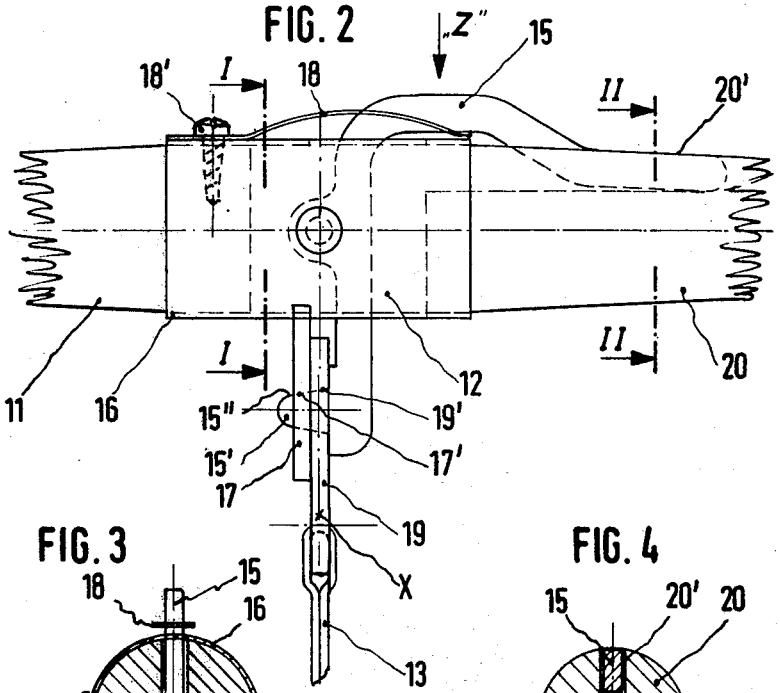
FIG. 2 is an enlarged view of the central part of the handle with the engagement and/or disengagement means.

In FIG. 2, the engagement and/or disengagement means 12 is illustrated and indicated on a larger scale. A coupling lever is denoted by 15, a tubular sleeve by 16, a coupling fishplate welded to the tubular sleeve 16 by 17, a curred flat leaf spring with a rectangular cutout by 18, a setscrew for leaf spring 18 by 18', a pull strap for a connecting strap by 19.

Figure 3:
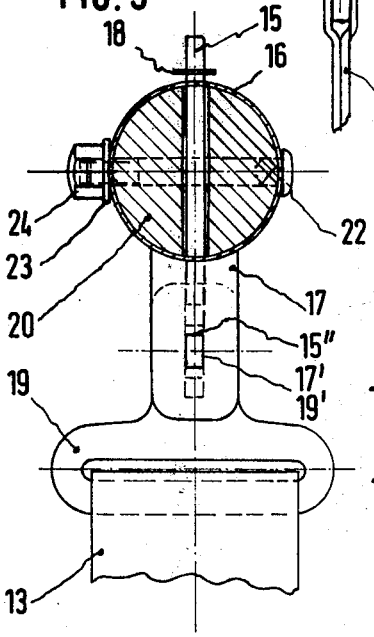
FIG. 3 is a section along line I—I in FIG. 2.

As in further apparent from FIG. 2, the connecting strap 13 (by which the belt 14 is securable to towline 10) is fastened through an aperture in pull strap 19 that is shown more clearly in FIG. 3. The pull strap, in turn, is connectable to handle 20 by a projection 15', at one end of lever 15, which projection passes through rectangular opening 19' in the strap and is received within an opening 17' of fishplate 17 which opening is complementarily shaped to the shape of projection 15'.

FIG. 3 shows a bearing for the engagement and/or disengagement means 12 and further components are illustrated, namely a bearing pin 22, a washer 23, and a self-locking cap screw 24. The bearing pin 22 is located on the centerline X of a handle arrangement 11 (FIGS. 1 and 2) so as to facilitate pivotal movement of coupling lever 15 to and from the position shown clamping pull strap 19 along said centerline.

Figure 4:
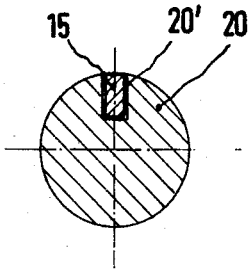
FIG. 4 is a section along line II—II in FIG. 2.

FIG. 4 shows, in conjunction with FIG. 2, how the coupling lever 15 is in hidden engagement in the handle zone 20' of the handle 20, when the coupling lever 15 is in an engagement position securing the handle to the connecting strap 13. This feature enables the lever 15 to function with a minimum of interference with the skier's grip upon the handle.

Figure 5:
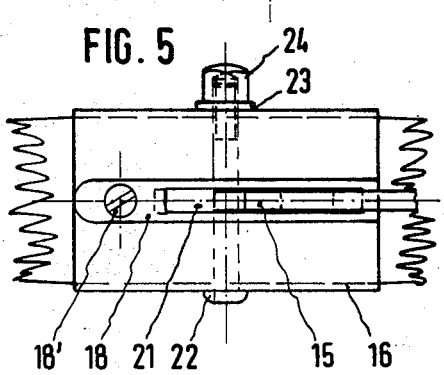
FIG. 5 is a top view in the direction "Z" in FIG. 2.

FIG. 5 shows the engagement and/or disengagement means of FIG. 2 in the direction "Z" wherein the rectangular cutout 21 of the curved leaf spring 18 can be discerned. The cutout 21 enables coupling lever 15 to pass through leaf spring 18 in a manner such that the end of the spring remote from screw 18' can act between handle 20 and an outwardly bowed portion of the lever 15 so as to apply a biasing force to be coupling lever tending to rotate it about pin 22 in a direction (counterclockwise in FIG. 2) away from fishplate 17.

The manner of use of the preferred embodiment will not be described. In preparation for skiing, the safety belt 14 is fastened about the skier's waist and is then connected to the handle assembly 11 by placing the opening 19' of strap 19 onto projection 15' of lever 15 after which, handle zone 20' is grasped causing pivotal movement of lever 15 into handle 20 and engagement of projection 15' within opening 17' of fishplate 17. Skiing can then commence; however, should the skier's hand be removed from zone 20' at any time (whether by deliberate act or mishap), the force of spring 18 will cause a return movement of coupling lever 15, thereby removing projection 15' from the opening 17'. Since the surface 15'' of projection 15' facing the towing direction is inclined away therefrom, complete separation of the safety belt from the towline is ensured as the pull strap 19 will slide therealong and off projection 15' under influence of forces pulling handle 20 away from connecting strap 13.

It is within the scope of this invention that the engagement and/or disengagement means 12 or the coupling lever 15 can be held open selectively by a plate spring, a compression spring, or a tension spring instead of or in addition to the leaf spring 18 and positioned at points other than that illustrated.

While I have shown and described one embodiment in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. A handle assembly for a water ski towline comprising a handle and engagement and disengagement means for a safety belt for water skiers, said handle being joined with said engagement and disengagement means, said engagement and disengagement means having means for retaining a pull strap of a safety belt connecting strap by engagement with one hand during the starting process and during skiing, and for enabling the entire tensile forces exerted by the towline to be trasmitted to the safety belt and thus to the body of the water skier, wherein said engagement and disengagement means comprises a coupling lever which extends centrally through the handle, and engages with a generally trapezoidal projection into a likewise generally trapezoidal opening in a coupling fishplate and into a rectangular opening of the pull strap, said pull strap being receivable between the coupling lever and fishplate.

2. A handle assembly for a water ski towline according to claim 1, wherein said projection has an unobstructing inclination with respect to the towing direction, thereby facilitating a sliding off of the pull strap after release of the coupling lever.

3. A handle assembly for a water ski towline according to claims 1 or 2, wherein the egagement and disengagement means includes a curved flat spring which, when the coupling lever is not activated, maintains the engagement and disengagement means of an open position and facilitates the locking of the pull strap.

4. A handle assembly for a water ski towline according to claim 3, characterized in that, due to a flat construction of the coupling lever, the handle can be fashioned to be easily grasped by hand, a hand engageable end thereof being received within a groove in the handle.

5. A handle assembly for a water ski towline comprising a handle and engagement and disengagement means for a safety belt for water skiers, said handle being joined with said engagement and disengagement means, said engagement and disengagement means having means for retaining a pull strap of a safety belt connecting strap by engagement with one hand during the starting process and during skiing, and for enabling the entire tensile forces exerted by the towline to be transmitted to the safety belt and thus to the body of the water skier, wherein said means for retaining comprises a fishplate secured to the handle and a coupling lever pivotally mounted within said handle, said coupling lever having a projection that is receivable within an opening in the fishplate for securing the pull strap therebetween.

6. A handle assembly according to claim 5, wherein said engagement and disengagement means comprises spring means for biasing said lever to a position whereat said projection is withdrawn from said fishplate opening.

7. A handle assembly for a water ski towline according to claim 5 or 6, wherein said projection has an unobstructing inclination, 8. A handle assembly for a water ski towline according to claim 5 or 6, characterized in that, due to a flat construction of the coupling lever, the handle can be fashioned to be easily grasped by hand, a hand engageable end thereof received within a groove in the handle.

9. A handle assembly for a water ski towline comprising a bar type handle that is grippable by both hands of a skier so as to be holdable in a generally horizontal orientation during skiing, and engagement and disengagement means for a safety belt for water skiers, said engagement and disengagement means being mounted to said handle at a location between areas grippable by respective hands of the skier so as to be manipulable between a first position for receiving a pull strap of a safety belt and a second position for releaseably retaining the pull strap of the safety belt by one hand for enabling the entire tensile forces exerted by the towline to be transmitted to the safety belt and thus to the body of the skier.

10. A handle assembly according to claim 9, wherein said engagement and disengagement means is constructed to be shiftable from said second position to said first position, in use, upon release of said one hand for producing disengagement of said pull strap from said engagement and disengagement means.

* * * * *